US006243001B1

(12) United States Patent
Kodaka

(10) Patent No.: US 6,243,001 B1
(45) Date of Patent: Jun. 5, 2001

(54) VARIABLE INTENSITY VISUAL SIGNALING SYSTEM

(75) Inventor: Akiyoshi Kodaka, Saitama-ken (JP)

(73) Assignee: Kobishi America, Carson, CA (US)

( * ) Notice: Subject to any disclaimer, the term of this patent is extended or adjusted under 35 U.S.C. 154(b) by 0 days.

(21) Appl. No.: 09/189,892

(22) Filed: Nov. 10, 1998

(51) Int. Cl.[7] ..... G08B 27/00
(52) U.S. Cl. ..... 340/326; 315/241 S
(58) Field of Search ..... 340/326, 293; 358/240; 315/241 S, 244

(56) References Cited

U.S. PATENT DOCUMENTS

| | | | | |
|---|---|---|---|---|
| 3,792,309 | * | 2/1974 | McDonald | 315/241 S |
| 3,810,170 | * | 5/1974 | Zinsmeister | 340/326 |
| 3,863,236 | * | 1/1975 | Clardy | 340/326 |
| 4,656,397 | * | 4/1987 | Chappell et al. | 315/241 S |
| 5,010,412 | * | 4/1991 | Garriss | 358/240 |
| 5,355,116 | * | 10/1994 | Applegate et al. | 340/326 |
| 5,602,522 | * | 2/1997 | Pacelli | 315/241 S |
| 5,608,375 | * | 3/1997 | Kosich | 340/293 |

OTHER PUBLICATIONS

"GENTEX", Fire Protection Products, Technical Services, by Fire Protection Products Group, Zeeland, Michigan, pp. 1–27.

GENTEX, Fire Protection Products by Fire Protection Products Group, Zeeland, Michigan, pp. 1–4.

"Strobe Compliance Reference Guide", Update I By System Sensor, A Division Of Pittway, St. Charles, IL, Version 2.0, May 1995, pp. 1–14.

"Alarm Signals", Alarm Signals for Fire and Life Safety Systems by Wheelock, Inc., Long Branch, NJ, ASC Rev. Feb. 1996, pp. 1–35.

* cited by examiner

*Primary Examiner*—Jeffery A. Hofsass
*Assistant Examiner*—John Tweel, Jr.
(74) *Attorney, Agent, or Firm*—Squire, Sanders & Dempsey LLP.; David B. Abel; Dave B. Koo

(57) ABSTRACT

An emergency signaling device for the hearing impaired provides a strobe light in which the intensity of the emitted light is variable. The emergency signaling device comprises a housing and a reflecting mirror coupled to the housing. A strobe light emitting device adapted to provide a sequence of flashing light is disposed in relation to the reflecting mirror so that the light is distributed in a predetermined pattern. The intensity level emitted by the strobe light emitting device may be varied between at least a first intensity level and a second intensity level. The reflecting mirror provides a polar light distribution of the flashing light. The rate of flashing of the strobe light emitting device may be synchronized with other emergency signaling devices.

25 Claims, 4 Drawing Sheets

VARIABLE INTENSITY VISUAL SIGNALING SYSTEM

BACKGROUND OF THE INVENTION

1. Field of the Invention

The present invention relates to fire emergency signaling systems, and more particularly, to a visual signaling system detectable by hearing impaired persons by providing a strobe light output that can be varied in intensity depending on a desired application.

2. Description of Related Art

Building fire warning systems are required by law and now commonplace in most commercial structures. These warning systems generally include an audible signaling device, such as a horn, siren or bell, that provides an audible signal at a decibel level sufficiently high to be heard by persons within a limited vicinity of the warning system. Audible signaling systems have a significant disadvantage in that they cannot be detected by persons that have impaired hearing. To address this serious deficiency, the fire safety industry introduced signaling devices which included a flashing strobe light in addition to the audible systems. In 1990, the Americans with Disabilities Act (ADA) recognized the importance of such visual signaling devices for assuring access to public facilities to persons with physical disabilities. The ADA specifically included provisions and standards for visual and audible signaling devices designed for the protection of the hearing impaired. Similarly, other industry-based regulatory bodies, such as the National Fire Protection Association (NFPA), Underwriter's Laboratories (UL), the American National Standards Institute (ANSI), and the National Electrical Manufacturers Association (NEMA), have also moved to require such visual signaling devices.

There are four general requirements of visual signaling devices, including intensity, flash rate, placement, and light distribution. Compliance with these four requirements is complicated, however, since the governmental and industry-based standards set forth inconsistent requirements for light intensity. Under the ADA, the visual signaling devices must provide a minimum light intensity of 75 candela (cd) in all areas and that the devices be spaced so that no place in any room is more than 50 feet from the nearest device. In contrast, the industry-based standards recognize that an equivalent illuminance to 75 cd can be achieved using lower intensity strobes (e.g.,15 or 30 cd) spaced closer together (e.g., within 20 feet). The industry-based standards also differ from the ADA in that they set forth different intensity requirements for sleeping and non-sleeping areas. Sleeping areas are given a much higher intensity requirement than non-sleeping areas so that the visual signaling devices will wake hearing impaired persons from their sleep.

The requirements for flash rate, light distribution, and placement also differ in certain respects. The ADA and other standards each require a flash rate from 1 to 3 Hz. Since some individuals are vulnerable to photosensitive epilepsy, it is undesirable to have multiple flashing strobes within an individual's field of view. To address this problem, the National Fire Alarm Code issued by the NFPA requires that the visual signaling devices flash in synchronization, while the ADA does not require synchronized flashing. Similarly, with respect to light distribution, the industry-based standards each require "polar" light distribution, while the ADA does not include any requirement for light distribution. Polar light distribution refers to the way the light intensity is measured in the horizontal and vertical directions at viewing angles ranging between 0 and 180 degrees. Lastly, the placement requirement of the ADA and other standards differs in that the ADA requires the visual signaling devices to be placed on the wall only, while the other standards permit wall or ceiling placement. It should be appreciated that the particular placement will affect the equivalent illuminance provided by the visual signaling devices, as discussed above.

There is a movement within the industry to standardize the various conflicting requirements of the ADA and industry-based standards. In the meantime, however, it is very difficult to provide a single visual signaling system that complies with all of the foregoing requirements. Accordingly, it would be very desirable to provide a visual signaling system that can be adapted for operation under any of the prevailing standards. Such a system would ideally comply with whatever requirements that are ultimately adopted as the various conflicting standards are eventually standardized.

SUMMARY OF THE INVENTION

An emergency signaling device for the hearing impaired provides a strobe light in which the intensity of the emitted light is variable. The emergency signaling device comprises a housing and a reflecting mirror coupled to the housing. A strobe light emitting device adapted to provide a sequence of flashing light is disposed in relation to the reflecting mirror so that the light is distributed in a predetermined pattern. The intensity level emitted by the strobe light emitting device may be varied between at least a first intensity level and a second intensity level.

In an embodiment of the invention, the emergency signaling device further comprises an oscillator for providing an oscillating signal. The oscillating signal is converted to a desired voltage level provided to the strobe light emitting device. The voltage level applied to the strobe light emitting device is changed, and thereby the intensity level of the strobe light emitting device is changed, by varying the frequency of the oscillating signal. The oscillator is provided by an operational amplifier having a feedback resistance defined between an inverting input terminal and an output terminal, and a capacitance defined between the inverting input terminal and a voltage reference. The frequency of the oscillating signal is changed by a switch adapted to couple an additional resistance in parallel with the feedback resistance. The oscillating signal is converted to a voltage level by an inductor and a capacitor coupled in parallel with the strobe light emitting device. The inductor stores current during a first portion of a cycle of the oscillating signal and the capacitor is charged to the voltage level during a second portion of a cycle of the oscillating signal.

The reflecting mirror further comprises four corner reflectors separated by channel segments disposed in first and second axial directions. Respective ones of the channel segments disposed in the first axial direction are further disposed at an angle with respect to each other, and respective ones of the channel segments disposed in the second axial direction are further disposed at an angle with respect to each other. The particular arrangement of the channel segments and corner reflectors produces a polar light distribution pattern.

A more complete understanding of the variable intensity visual signaling system will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a visual signaling system that can be adapted for operation under any of the prevailing standards. It is anticipated that the system described herein would comply with whatever requirements that are ultimately adopted as the various conflicting standards are eventually standardized. In the detailed description that follows, like element numerals are used to describe like elements illustrated in one or more of the figures.

Figure 1:
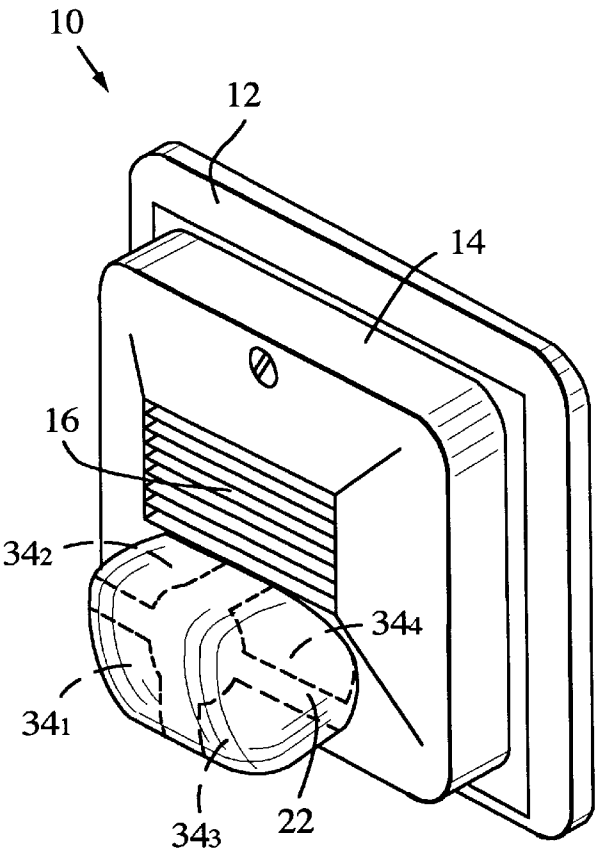
FIG. 1 is a perspective view of an exemplary wall-mounted signaling device in accordance with the present invention.

Referring first to FIG. 1, a perspective view of an exemplary fire emergency signaling device 10 is illustrated. It is anticipated that the signaling device 10 be mounted to an interior wall of a building or other public facility, though it should be appreciated that the present invention is equally applicable to ceiling-mounted signaling devices. The wall would typically include an outlet box (not shown) provided therein that facilitates electrical and mechanical connection to the signaling device 10. The signaling device 10 includes a mounting plate 12 and a housing 14. The mounting plate 12 provides a decorative frame that comes into contact with the wall and surrounds the housing 14. The mounting plate 12 additionally masks any unsightly edges of the outlet box that may be visible. The housing 14 protrudes outwardly from the mounting plate 12, and contains the electrical circuitry of the signaling device. A grille 16 is provided in the forward-facing surface of the housing 14. A sound generating device, such as a speaker, may be disposed within the housing 14 adjacent to the grille 16. The grille 16 includes louvers that permit movement of air from the speaker within the housing while precluding condensation from entering the housing. The housing 14 may be comprised of a lightweight material, such as thermoplastic or sheet metal.

The signaling device 10 further includes a transparent dome 22 which covers a portion of the forward-facing surface of the housing 14 adjacent to the grille 16. The transparent dome 22 provides a cover for a reflecting mirror (described below) used to reflect the signaling strobe light, and also serves as a lens to focus the transmitted light. The transparent dome 22 serves to protect the relatively delicate reflecting mirror and strobe light emitter from inadvertent harm. The transparent dome 22 may be comprised of clear plastic or glass to permit the signaling light to pass entirely therethrough without distortion, and has a generally rounded or oval shape. It should be appreciated that other shapes and configurations of the signaling device 10, and particularly the transparent dome 22, may be utilized in accordance with the present invention.

Figure 2A:
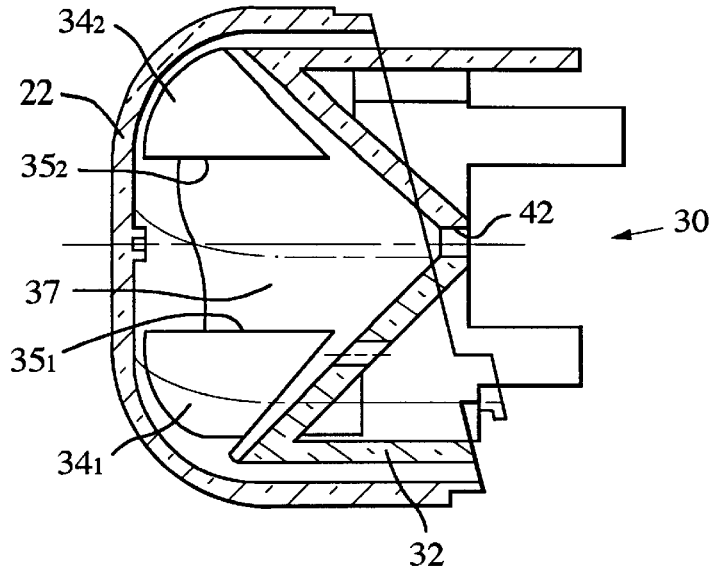
FIGS. 2A–2C are various views of a mirror and dome used in the exemplary signaling device.
Figure 2B:
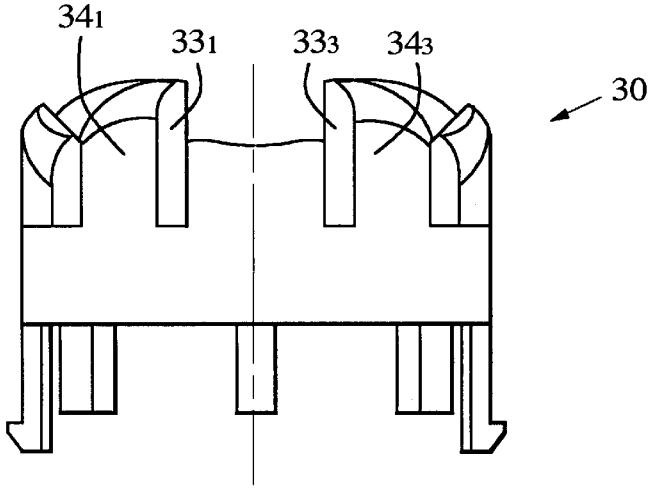
Figure 2C:
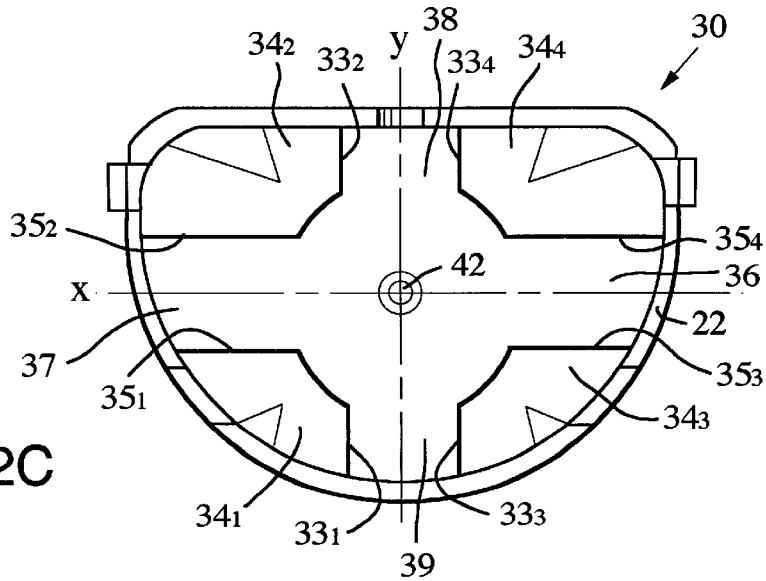

Referring now to FIGS. 2A–2C, the transparent dome 22 and reflecting mirror 30 are illustrated in greater detail. The reflecting mirror 30 further includes four corner reflectors $\mathbf{34}_1$–$\mathbf{34}_4$ disposed at respective quadrants of the mirror, as shown in FIG. 2C. The corner reflectors $\mathbf{34}_1$–$\mathbf{34}_4$ are separated in a first axial dimension (hereinafter referred to as the x-axis) by channel segments 36, 37, and are separated in a second axial dimension (hereinafter referred to as the y-axis) by channel segments 38, 39. The first axial dimension and channel segments 36, 37 are disposed perpendicularly with reference to the second axial dimension and channel segments 38, 39. The corner reflectors $\mathbf{34}_1$–$\mathbf{34}_4$ further include first side walls $\mathbf{35}_1$–$\mathbf{35}_4$ that define the edges of the x-axis channel segments 36, 37 and second side walls $\mathbf{33}_1$–$\mathbf{33}_4$ that define the edges of the y-axis channel segments 38, 39. The x-axis channel segments 36, 37 are disposed on an angle with respect to each other such that the channel segments are closest to the transparent dome 22 at outermost edges thereof, as shown in cross section in FIG. 2A. Similarly, the y-axis channel segments 38, 39 are disposed on an angle with respect to each other such that the channel segments are closest to the transparent dome 22 at outermost edges thereof. At the center of the intersection formed between the x-axis channel segments 36, 37 and the y-axis segments 38, 39 is a hole 42 through which a strobe light emitter is disposed, such as a xenon tube. The hole 42 is disposed at the most distant point of the reflecting mirror 30 from the transparent dome 22.

The various surfaces of the reflecting mirror 30, and particularly the x and y-axis channel segments 36, 37, 38, 39, may be comprised of a light reflective material, such as metal, or alternatively, may be comprised of thermoplastic material provided with a light reflective coating. It should be appreciated that the x-axis channel segments 36, 37 serve to reflect light in a first generally planar region having a field of view defined by the angle between the x-axis channel segments. Similarly, the y-axis channel segments 38, 39 serve to reflect light in a second generally planar region having a field of view defined by the angle between the y-axis channel segments. In a preferred embodiment of the reflecting mirror, the angle between each of the x-axis channel segments 36, 37 and the y-axis channel segments 38, 39 is 90 degrees. The orientation of the x and y-axis channel segments 36, 37, 38, 39 is intended to provide a polar light distribution to enable a person to see the strobe light from a wide range of viewing angles. The four corner reflectors $\mathbf{34}_1$–$\mathbf{34}_4$ serve to further direct light from the strobe light emitter onto the x and y-axis channel segments 36, 37, 38, 39 to concentrate the strobe light in the polar light distribution.

Figure 5A:
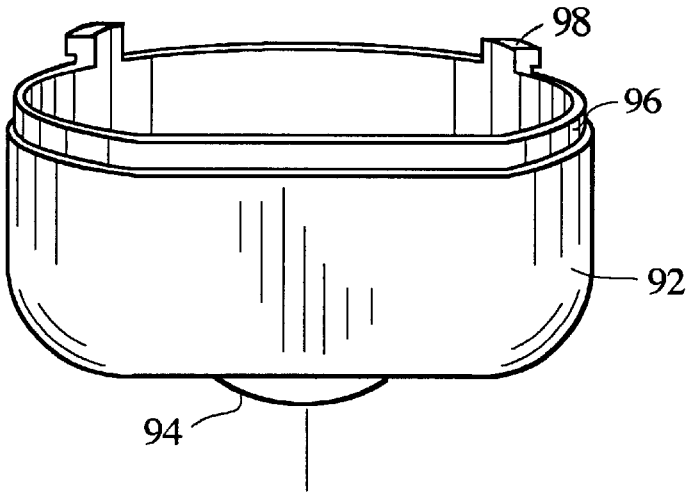
FIGS. 5A–5C are various views of an alternative embodiment of a dome for use in the exemplary signaling device.
Figure 5C:
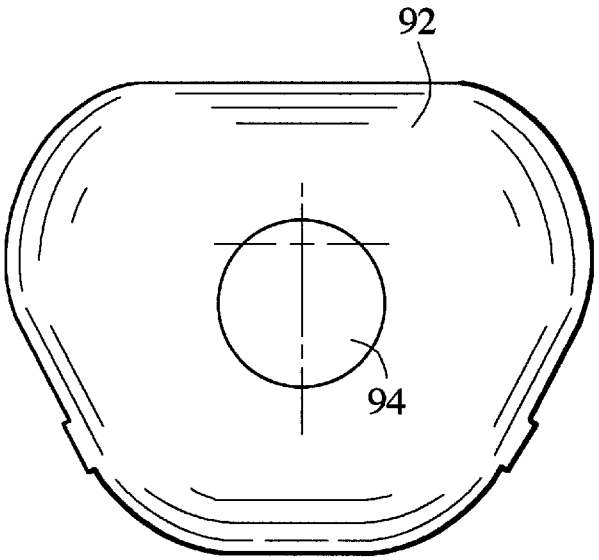
Figure 5B:
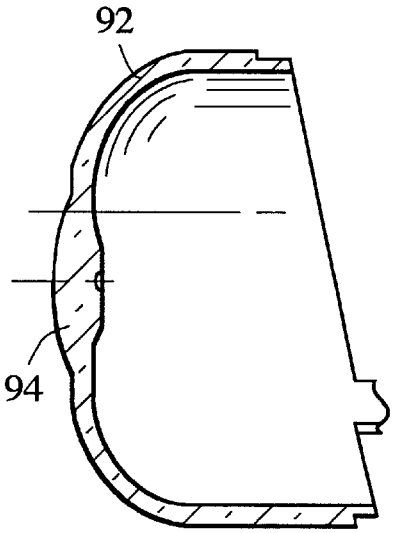

FIGS. 5A–5C illustrate an alternative embodiment of a dome 92 used to cover the reflecting mirror 30. The dome 92 includes a convex lens 94 disposed in a central portion of the dome, corresponding to the center of the intersection formed between the x-axis channel segments 36, 37 and the y-axis segments 38, 39 of FIGS. 2A–2C. As described above, the dome 92 may be comprised of transparent materials such as glass or plastic. An outer edge region 96 permits the dome 92 to engage the forward-facing surface of the housing 14, and further includes hooks 98 that engage corresponding members of the housing. The lens 94 cooperates with the reflecting mirror 30 to satisfy the polar light distribution requirements by dispersing and focusing the reflected light. The dome 92 may further include concave lens portions as well as prism regions disposed along the x-axis and y-axis dimensions.

Figure 3:
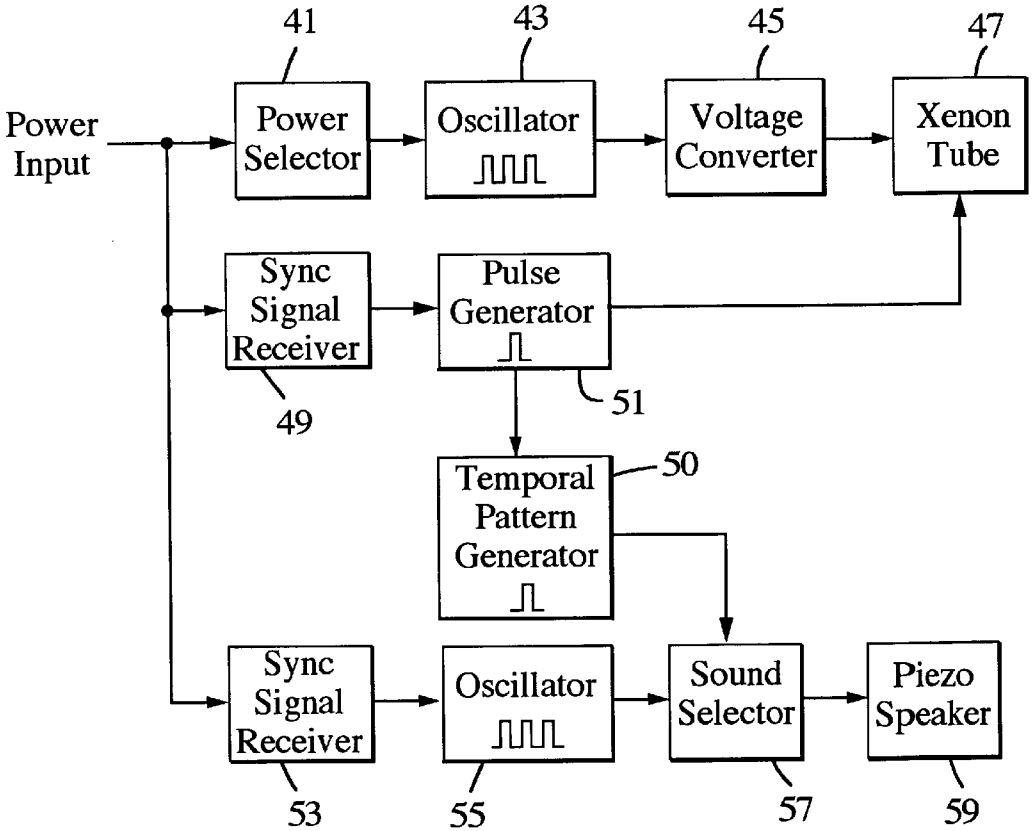
FIG. 3 is a block diagram illustrating the interconnection of functional elements of the exemplary signaling device.

Referring now to FIG. 3, a block diagram showing the functional elements of the signaling device 10 is provided.

The signaling device receives a DC power input signal (such as 24 volts DC) onto which one or more synchronization signals may be superimposed. A first type of synchronization signal enables the flashing rate of the strobe light to be synchronized with that of other signaling devices that may be operating simultaneously within the same field of view. Similarly, the second type of synchronization signal enables the audible tone generated by the signaling device to be synchronized with that of other signaling devices within the same range of hearing. The use of these synchronization signals is well known in the art.

The signaling device includes a power selector 41, an oscillator 43, a voltage converter 45 and a xenon tube 47. The xenon tube 47 provides the strobe light emitter, and the power selector 41, oscillator 43, and voltage converter 45 provide a DC-to-DC converter used to provide driving current for the xenon tube. More particularly, the DC power input signal is provided to the power selector 41 which determines the intensity level of the emitted strobe light. The power selector 41 may include a switch or potentiometer that allows a user to select between defined power levels. It should be appreciated that the power level applied to the strobe light emitter corresponds to the intensity level of the emitted strobe light. The oscillator 43 provides an oscillating or AC signal the frequency of which depends on the power level selected by the power selector 41. The voltage converter 45 converts the AC signal generated by the oscillator 43 back into a DC voltage used to drive the xenon tube 47 (such as around 270 volts DC). A sync signal receiver 49 demodulates the synchronization signal that is superimposed on the power input signal. The sync signal drives a pulse generator 51 to provide a series of triggering pulses at a timing defined by the synchronization signal. The triggering pulses from the pulse generator 51 are provided to the xenon tube 47, which trigger the xenon tube to flash once for each such triggering pulse.

A second sync signal receiver 53 demodulates a second synchronization signal superimposed on the power input signal for synchronizing the audible tones generated by the signaling device. As known in the art, the audible tones generated by a signaling device can be provided in several patterns. The simplest pattern comprises a continuous periodic signal with pulses of a fixed on-duration separated by periods of a fixed off-duration. A more complex pattern is defined by ISO 9000, referred to as a temporal sound pattern, comprises a short series of pulses (such as three pulses) having a fixed on-duration separated by periods of a fixed off-duration, with successive ones of the series separated by a longer off-duration. Other types of patterns may also be generated, such as a warble tone or a continuous sound. The second synchronization signal recovered by the sync signal receiver 53 is used to drive an oscillator 55 that generates a continuous series of pulses. A temporal pattern generator 50 determines the pattern of audible tones to be provided by the signaling device. As discussed above, the pulse generator 51 that triggers the xenon tube 47 may also be used to trigger the temporal pattern generator 50, so that the longer off-duration which separates the short series of pulses is synchronized to the flashing of the strobe light. The temporal pattern generator 50 and the oscillator 55 provide signals to a sound selector 57 that generates audio tone signals. The audio tone signals are provided to a piezoelectric speaker 59, which converts the tone signals into audible tones. It should be appreciated that the signaling device may not necessarily include an audible tone generator, and that separate signaling devices may be used for visual and audible signaling.

Figure 4:
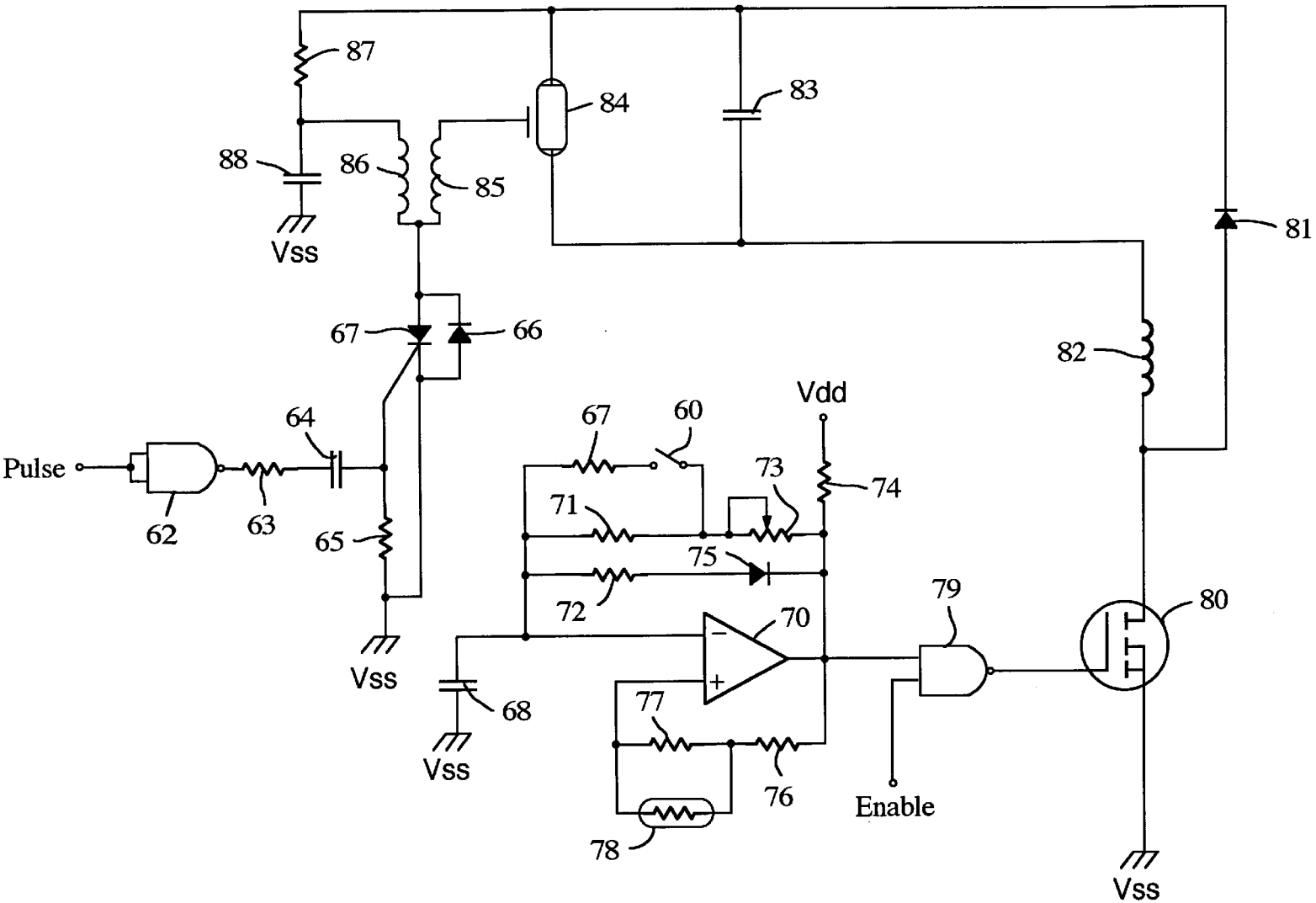
FIG. 4 is a schematic drawing of an embodiment of a variable power control circuit for use in the exemplary signaling device.

An embodiment of the strobe driving portions of the signaling device is shown in greater detail in FIG. 4. An oscillator circuit is provided by an operational amplifier 70 that has an inverting input terminal coupled to ground (Vss) through a capacitor 68. A DC voltage source (Vdd) is coupled to the output terminal of the operational amplifier across a resistor 74. Resistors 71, 72 and 73 define a feedback resistance coupled between the output terminal of the operational amplifier 70 and the inverting input terminal. The resistor 72 is disposed in parallel with the resistors 71 and 73 which are coupled in series. The resistor 73 is a variable resistor which permits the feedback resistance value to be calibrated to a desired level. A diode 75 is provided in series with the resistor 77 to prevent current from conducting in the forward direction through the feedback resistance.

An additional resistor 69 is provided in series with a switch 60. With the switch 60 in the closed position, the resistor 69 is coupled in parallel with the resistor 71, which alters the feedback resistance value. Conversely, with the switch 60 in the open position, the resistor 69 has no effect on the feedback resistance value. As known in the art, the frequency of an oscillating signal provided at the output of the operational amplifier 70 is proportional to the inverse of the product of the feedback resistance and the capacitance at the inverting input terminal (1/RC). Thus, the switch 60 enables the oscillator circuit to operate at two different frequencies. As will be further described below, the two different frequencies cause the xenon tube to be driven at different current levels, providing two intensity levels of operation of the signaling device. It is anticipated that the switch 60 be provided on an external surface of the housing 14, so that an operator or installer of the signaling device may select a desired intensity level.

The oscillating signal from the operational amplifier 70 is provided to an input terminal of a NAND gate 79. A second input terminal of the NAND gate 79 is coupled to an enabling signal. When the enabling signal is applied to the NAND gate 79, the oscillating signal passes therethrough. The oscillating signal is then provided to the gate of a transistor 80, such as a MOSFET. The transistor 80 is driven to conduction by positive-going cycles of the oscillating signal. A voltage converter circuit is provided by an inductor 82 and a capacitor 83 coupled in parallel. The inductor 82 is coupled to the drain of the transistor 80. When the transistor 80 is in a conducting state, an electrical current is drawn into the inductor 82. Then, when the transistor 80 is non-conductive, the current discharges into the capacitor 83, which achieves a particular voltage. The capacitor 83 is coupled in parallel across the xenon tube 84, such that the voltage across the capacitor is applied across the xenon tube. As known in the art, the voltage across the xenon tube determines the brightness or intensity of its light output. The frequency of the oscillating signal provided from the operational amplifier 70 determines the amount of charging of the capacitor 83. Thus, by varying the frequency of the oscillating signal, the intensity of the xenon tube 84 can be varied.

The xenon tube 84 further includes an anode 90 that triggers the flashing of the tube. A triggering pulse is provided to an inverter 62, a resistor 63 and a capacitor 64. The capacitor 64 filters high frequency components of the triggering pulse, such as harmonics of the triggering pulse. The anode 90 is coupled to a transformer having mutual inductances 85, 86 that are coupled to ground through a pair of alternating diodes 66, 67. Between triggering pulses, a voltage is provided across resistor 65, which draws a current through diode 66 that is stored in inductors 86 and 85. The voltage defined across the inductor 85 causes the anode to stand off conduction within the xenon tube 84. When the triggering pulse is provided, however, the current reverses direction and discharges from the inductors 86, 85 through diode 67. The discharging of the inductor 85 causes the voltage to drop at the anode 90 and the xenon tube 84 conducts current, resulting in a momentary flash of light from the xenon tube. In a preferred embodiment of the invention the feedback resistance between the inverting input terminal and the output terminal of the operational amplifier 70 is selected to generate oscillating signals that result in intensity levels of the xenon tube 84 of 15 and 30 cd, as determined by the position of the switch 60.

A feedback resistance is also defined between the output terminal of the operational amplifier 70 and the non-inverting input terminal of the operational amplifier. This feedback resistance includes resistors 76, 77, and 78. Resistor 78 further comprises a thermister, which has a resistance value that varies with the temperature of the device. This way, if the signaling device becomes excessively hot due to flashing of the xenon tube 84, the frequency of the oscillating signal provided by the operational amplifier 70 will decrease due to the increased feedback resistance at the non-inverting input terminal. The decreased frequency results in a reduced light intensity of the xenon tube 84, which serves to prevent the signaling device 10 from overheating.

Having thus described a preferred embodiment of the variable intensity visual signaling system, it should be apparent to those skilled in the art that certain advantages of the foregoing system have been achieved. It should also be appreciated that various modifications, adaptations, and alternative embodiments thereof may be made within the scope and spirit of the present invention. The invention is further defined by the following claims.

What is claimed is:

1. An emergency signaling device, comprising:

a housing;

a reflecting mirror coupled to said housing;

a strobe light emitting device adapted to provide a sequence of flashing light, said strobe light emitting device being disposed in relation to said reflecting mirror so that said light is distributed in a predetermined pattern; and means for varying an intensity level emitted by said strobe light emitting device between at least a first intensity level and a second intensity level, said varying means comprising means for providing an oscillating signal having a feedback resistance.

2. The emergency signaling device of claim 1, wherein said varying means further comprises:

means for converting said oscillating signal to a voltage level provided to said strobe light emitting device; and means for changing a frequency of said oscillating signal.

3. An emergency signaling device, comprising:

a housing;

a reflecting mirror coupled to said housing;

a strobe light emitting device adapted to provide a sequence of flashing light, said strobe light emitting device being disposed in relation to said reflecting mirror so that said light is distributed in a predetermined pattern; and means for varying an intensity level emitted by said strobe light emitting device between at least a first intensity level and a second intensity level, wherein said varying means further comprises:

means for providing an oscillating signal including an operational amplifier having a feedback resistance defined between an inverting input terminal and an output terminal, and a capacitance defined between said inverting input terminal and a voltage reference;

means for converting said oscillating signal to a voltage level provided to said strobe light emitting device; and means for changing a frequency of said oscillating signal.

4. The emergency signaling device of claim 3, wherein said means for changing a frequency of said oscillating signal further comprises a switch adapted to couple an additional resistance in parallel with said feedback resistance.

5. The emergency signaling device of claim 4, wherein said switch is disposed on said housing.

6. The emergency signaling device of claim 3, wherein said converting means further comprises an inductor and a capacitor coupled in parallel with said strobe light emitting device, said inductor storing current during a first portion of a cycle of said oscillating signal and said capacitor being charged to said voltage level during a second portion of a cycle of said oscillating signal.

7. The emergency signaling device of claim 1, wherein said strobe light emitting device further comprises a xenon tube.

8. An emergency signaling device, comprising:

a housing;

a reflecting mirror coupled to said housing;

a strobe light emitting device adapted to provide a sequence of flashing light, said strobe light emitting device being disposed in relation to said reflecting mirror so that said light is distributed in a predetermined pattern; and means for varying an intensity level emitted by said strobe light emitting device between at least a first intensity level and a second intensity level, wherein said reflecting mirror further comprises four corner reflectors separated by channel segments disposed in first and second axial directions.

9. The emergency signaling device of claim 8, wherein respective ones of said channel segments disposed in said first axial direction are further disposed in an angle with respect to each other to provide said predetermined pattern.

10. The emergency signaling device of claim 9, wherein respective ones of said channel segments disposed in said second axial direction are further disposed in an angle with respect to each other to provide said predetermined pattern.

11. The emergency signaling device of claim 1, wherein said predetermined pattern further comprises a polar light distribution pattern.

12. The emergency signaling device of claim 1, further comprising means for synchronizing said flashing light to at least one other emergency signaling device.

13. The emergency signaling device of claim 1, wherein said first intensity level further comprises 15 candela.

14. The emergency signaling device of claim 13, wherein said second intensity level further comprises 30 candela.

15. The emergency signaling device of claim 1, further comprising an acoustic emitting device adapted to provide a repeating sequence of acoustic tones.

16. The emergency signaling device of claim 15, wherein said acoustic emitting device further comprises a piezoelectric speaker.

17. The emergency signaling device of claim 15, wherein said repeating sequence of acoustic tones further comprises a temporal pattern.

18. The emergency signaling device of claim 15, further comprising means for synchronizing said sequence of flashing light to said sequence of acoustic tones.

19. The emergency signaling device of claim 1, further comprising a transparent dome covering said reflecting mirror.

20. The emergency signaling device of claim 19, wherein said transparent dome further comprises a lens.

21. In an emergency signaling device comprising a strobe light emitting device adapted to provide a sequence of flashing light distributed in a predetermined pattern, a method for operating the strobe light comprises varying an intensity level emitted by said strobe light emitting device between at least a first intensity level and a second intensity level, wherein varying the intensity level further comprises the steps of providing an oscillating signal by using an oscillator including an operational amplifier having a feedback resistance between an inverting input terminal and an output terminal, and adding or removing the feedback resistance.

22. The method of claim 21, wherein said varying step further comprises:

converting said oscillating signal to a voltage level provided to said strobe light emitting device; and changing a frequency of said oscillating signal.

23. The method of claim 21, further comprising the step of synchronizing said flashing light to at least one other emergency signaling device.

24. The method of claim 21, further comprising the step of projecting said flashing light in a polar light distribution pattern.

25. The method of claim 21, further comprising the step of synchronizing said sequence of flashing light to a sequence of acoustic tones.

* * * * *